US007309365B2

(12) United States Patent
Yuasa et al.

(10) Patent No.: US 7,309,365 B2
(45) Date of Patent: Dec. 18, 2007

(54) VACUUM CLEANER

(75) Inventors: Yasuhiro Yuasa, Shiga (JP); Akihito Ito, Shiga (JP); Takafumi Ishibashi, Shiga (JP); Kazuhisa Morishita, Shiga (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 482 days.

(21) Appl. No.: 10/684,481

(22) Filed: Oct. 15, 2003

(65) Prior Publication Data

US 2004/0078921 A1 Apr. 29, 2004

(30) Foreign Application Priority Data

Oct. 15, 2002 (JP) ..... 2002-300119
Oct. 18, 2002 (JP) ..... 2002-304800

(51) Int. Cl.
*B01D 46/00* (2006.01)
*B01D 50/00* (2006.01)

(52) U.S. Cl. ..... 55/283; 55/300; 55/467; 55/471; 55/472; 55/473; 55/DIG. 2; 55/DIG. 3; 55/DIG. 34; 96/397; 96/398; 96/399; 96/403; 96/404; 96/408; 96/428; 96/429; 96/430; 96/226; 15/347; 15/352

(58) Field of Classification Search ..... 55/283, 55/300, DIG. 2, DIG. 3, 467, 471–473, DIG. 34; 15/347, 352; 96/417–420, 226, 397–399, 96/403, 404, 408, 428, 429, 430
See application file for complete search history.

(56) References Cited

U.S. PATENT DOCUMENTS 3,667,084 A * 6/1972 Valbona et al. ..... 15/323
3,695,006 A * 10/1972 Valbona et al. ..... 96/420
3,906,756 A * 9/1975 Bone ..... 68/18 F
4,545,794 A * 10/1985 Himukai ..... 55/362
5,240,484 A * 8/1993 Genovese et al. ..... 96/226
5,352,255 A * 10/1994 Taft ..... 96/419
6,117,200 A * 9/2000 Berg et al. ..... 55/287
6,228,155 B1 * 5/2001 Tai ..... 96/413
6,626,973 B2 * 9/2003 Park ..... 55/480
6,712,868 B2 * 3/2004 Murphy et al. ..... 55/330

FOREIGN PATENT DOCUMENTS

| | | |
|---|---|---|
| EP | 0 564 817 | 10/1993 |
| EP | 1 023 967 | 8/2000 |
| EP | 1 136 028 | 9/2001 |
| GB | 614540 | 12/1948 |
| GB | 963672 | 7/1964 |
| GB | 2 314 008 | 12/1997 |
| GB | 2 355 392 | 4/2001 |
| JP | 5091962 | 4/1993 |
| WO | 01/32066 | 5/2001 |

* cited by examiner

*Primary Examiner*—Duane Smith
*Assistant Examiner*—Minh-Chau T. Pham
(74) *Attorney, Agent, or Firm*—Bacon & Thomas, PLLC

(57) ABSTRACT

A vacuum cleaner including an electric blower for generating suction air, a collecting unit for collecting dust contained in the suction air, a dust removing unit for removing dust adhered to the collecting unit, and a dust removing stop unit for stopping an operation of the dust removing unit. The dust removing stop unit stops the operation of the dust removing unit in response to a user's selection or an operation mode of the vacuum cleaner, thereby saving a power consumption of the dust removing unit.

20 Claims, 10 Drawing Sheets

VACUUM CLEANER

FIELD OF THE INVENTION

The present invention relates to a vacuum cleaner incorporating therein a dust collecting unit.

DESCRIPTION OF THE PRIOR ART

One of conventional vacuum cleaners is disclosed in Japanese Patent Laid-Open Publication No. 1993-91962. Hereinafter, the conventional vacuum cleaner will be explained in conjunction with FIGS. 16 to 18.

Referring to FIG. 16, there is provided extension tube 2, one end thereof being detachably attached to suction nozzle 3 and the other end thereof being coupled to handle 4. Hose 6 extending from handle 4 is detachably connected to main body 1 having dust chamber 11 for collecting dust.

Reference numeral 13 represents a hood provided above an upper portion of dust chamber 11, which can be opened and closed when removing the dust from dust chamber 11. Reference numeral 7 is a grip manipulation unit installed on handle 4, which is provided with high power switch 21, normal power switch 22, low power switch 23 and power off switch 24 as shown in FIG. 18. The mode of the vacuum cleaner can be changed by manipulating grip manipulation unit 7.

As shown in FIG. 17 representing a partial cutaway cross sectional view of main body 1, main body 1 is divided into two portions by partition 5 having communication holes 19. Included in a front portion of main body 1 is dust chamber 11 and disposed in a rear portion thereof is electric blower housing chamber 8 incorporating therein electric blower 12 for generating suction air for the intake of dust. The suction air is introduced from dust chamber 11 to a suction inlet of electric blower 12 via communication holes 19.

A control unit (not shown) controls electric blower 12 by using three operation modes, e.g., a high power mode for driving electric blower 12 with a power of 900 W, a normal power mode with 600 W and a low power mode with 200 W, and a power off mode cutting off a power to electric blower 12. Grip manipulation unit 7 can be manipulated to select one of the respective four power modes. In other words, the high power mode is selected by activating high power switch 21; the normal power mode, by normal power switch 22; the low power mode, by low power switch 21; and the power off mode, by power off switch 24.

In each of the high, the normal and the low power mode (referred to operation modes hereinafter), the suction air generated by the suction force of electric blower 12 is provided to electric blower 12 through suction nozzle 3, extension tube 2, hose 6, dust chamber 11 and communication holes 19, which are included in a path of the suction air.

Generally, dust chamber 11 is provided with dust bag 14 to filter the dust included in dust-laden air and accumulate the collected dust therein. When such dust bag 14 is disposed in the suction path at an upstream side of electric blower 12, the dust tends to adhere to a part of the inner surface of dust bag 14 through which the suction air flows, thereby reducing the suction force. To solve the problem, there has been proposed a vacuum cleaner incorporating therein a dust removing unit for removing the adhered dust off the dust bag to recover the suction force.

However, in such a conventional vacuum cleaner, the dust removing operation cannot be stopped in response to the operational conditions or circumstances of the vacuum cleaner, wherein the dust removing operation is unnecessary, thereby wasting power for operation of the dust removing unit.

SUMMARY OF THE INVENTION

It is, therefore, an object of the present invention to provide a vacuum cleaner capable of saving power consumption of a dust removing unit and enhancing convenience by halting the dust removing operation in response to the user's selection or operational circumstances of the vacuum cleaner.

In accordance with a preferred embodiment of the present invention, there is provided a vacuum cleaner including an electric blower for generating suction air; a collecting unit for collecting dust contained in the suction air; a dust removing unit for removing dust adhered to the collecting unit; and a dust removing stop unit for stopping an operation of the dust removing unit.

In accordance with another preferred embodiment of the present invention, there is provided a vacuum cleaner including an electric blower for generating suction air; a collecting unit for collecting dust contained in the suction air; a dust removing unit for removing dust adhered to the collecting unit; and indication unit for informing a user of an operation state of the dust removing unit.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF THE PREFERRED EMBODIMENTS

Figure 16:
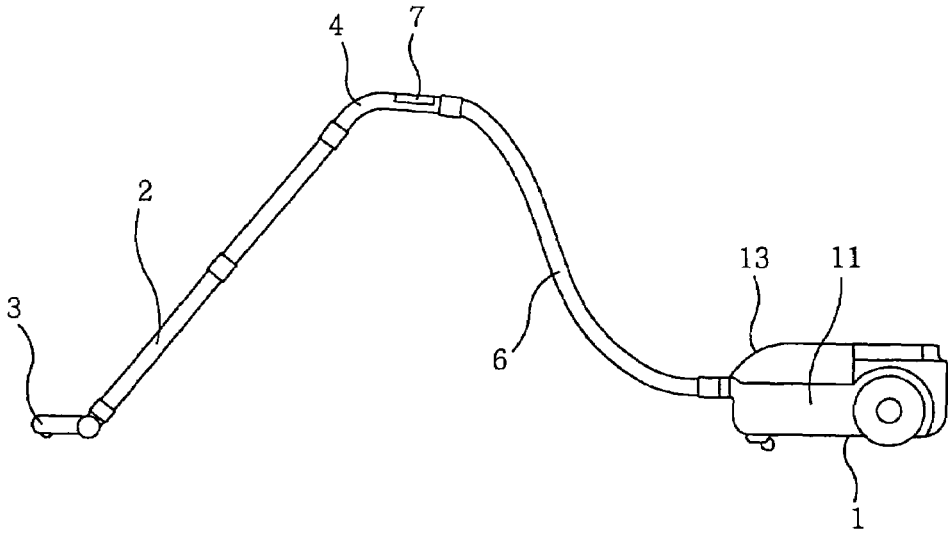
FIG. 16 provides a schematic diagram of a general vacuum cleaner.
Figure 17:
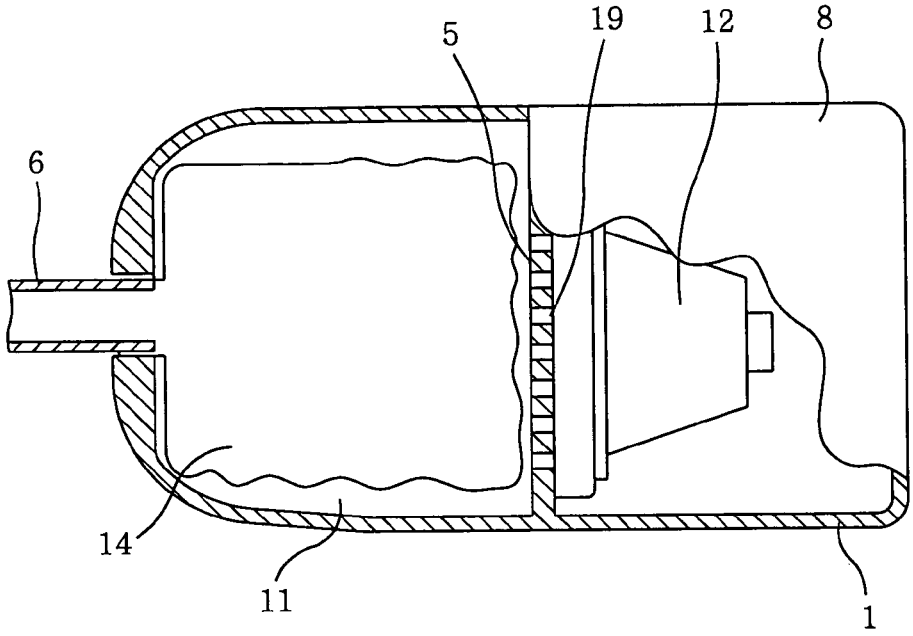
FIG. 17 depicts a partial cutaway cross sectional view of a main body of the general vacuum cleaner.
Figure 18:
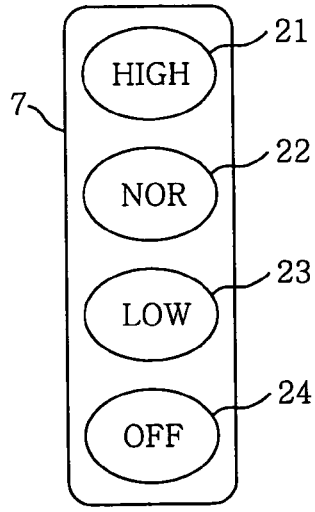
FIG. 18 shows a schematic diagram illustrating a grip manipulation unit of the general vacuum cleaner.

A first preferred embodiment will now be described with reference to FIGS. 1 to 3. Similar parts to those of FIGS. 16 to 18 are represented by similar reference numerals to those thereof and detailed explanation thereof will be omitted.

Figure 1:
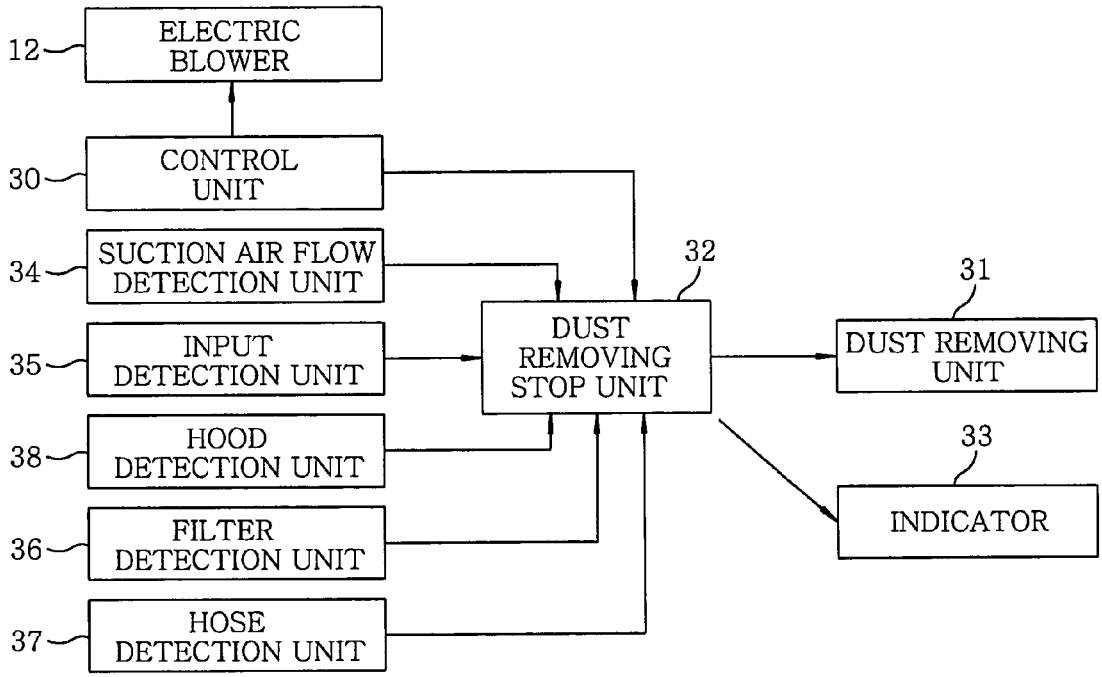
FIG. 1 represents a block diagram for controlling a vacuum cleaner in accordance with a first preferred embodiment of the present invention.

FIG. 1 illustrates a block diagram for controlling a vacuum cleaner in accordance with a first preferred embodiment of the present invention. Referring to FIG. 1, the vacuum cleaner includes electric blower 12 for generating suction air for the intake of dust; control unit 30 for controlling an input, i.e., a power, supplied to electric blower 12; dust removing unit 31 for performing a dust removing operation; dust removing stop unit 32 for stopping the dust removing operation; LED (Light Emitting Diode) indicator 33 for informing the user of the stop of the dust removing operation of dust removing unit 31; and suction air flow detection unit 34 for detecting an amount of suction air flow by measuring a current through electric blower 12. Also, included in the vacuum cleaner are input detection unit 35 for detecting an input, i.e., a power set by control unit 30 to be inputted to electric blower 12; filter detection unit 36 for detecting the presence of a dust collecting unit, e.g., a dust bag; hose detection unit 37 for detection whether hose 6 is connected; and hood detecting unit 38 for detecting whether hood 13 of dust chamber 11 is open or not.

Figure 2:
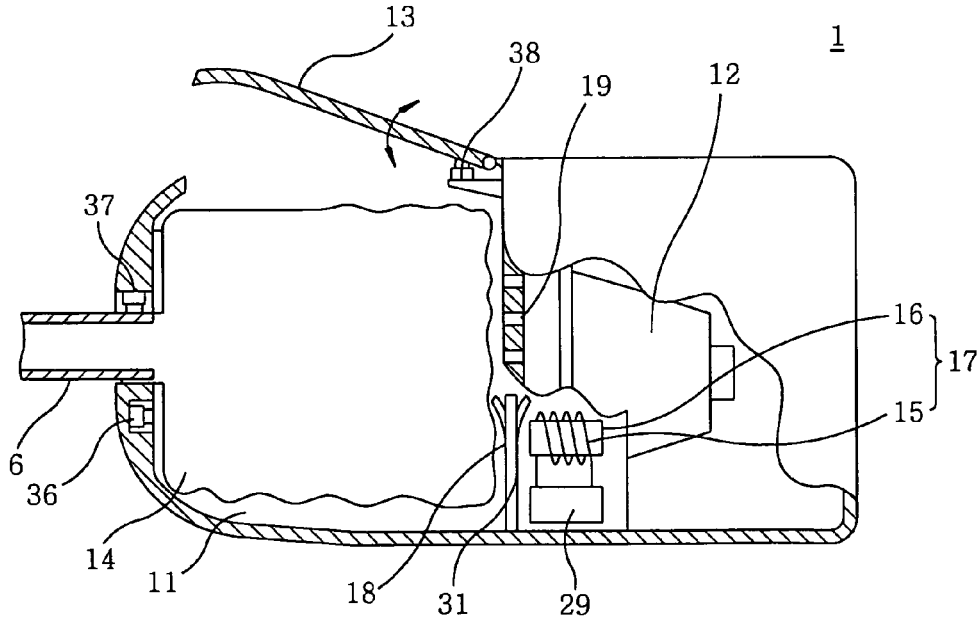
FIG. 2 illustrates a schematic partial cutaway cross sectional view of a main body of the vacuum cleaner in accordance with the first preferred embodiment of the invention.

FIG. 2 illustrates a schematic partial cutaway cross sectional view of main body 1 of the vacuum cleaner in accordance with the first preferred embodiment of the invention. Referring to FIG. 2, dust removing unit 31 includes vibrator 18 for vibrating dust bag 14 which collects the dust therein; electromagnet 17 for operating vibrator 18; and control circuit 29 for controlling a current flowing through electromagnet 17. Electromagnet 17 incorporating therein coil 15 and core 16 is disposed near vibrator 18 to vibrate it by applying a magnetic field thereto. When an AC voltage is applied to control circuit 29, the half-wave rectified AC voltage is provided to coil 15. Since the half-wave rectified AC voltage is applied to coil 15, an intermittent current flows through coil 15, thereby rendering the magnetic field generated by electromagnet 17 intermittent. Therefore, electromagnet 17 repeatedly performs a pull-and-release operation for vibrator 18 to thereby induce vibration of vibrator 18. As a result, vibrator 18 removes the dust inside dust bag 14 by way of knocking or shaking the dust off the inner surface thereof.

Figure 3:
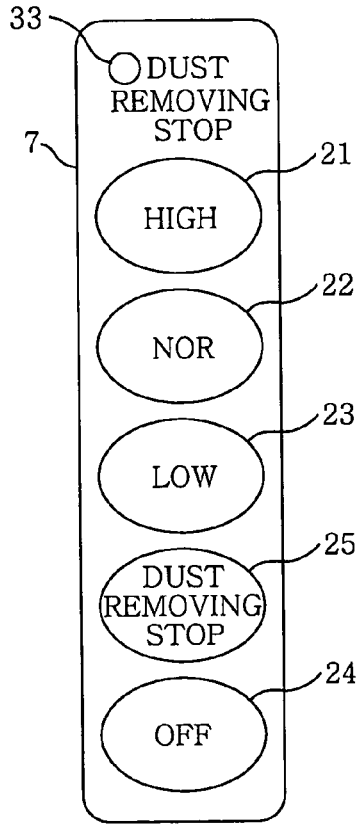
FIG. 3 shows a schematic diagram illustrating a grip manipulation unit of the vacuum cleaner in accordance with the first preferred embodiment of the invention.
Figure 4:
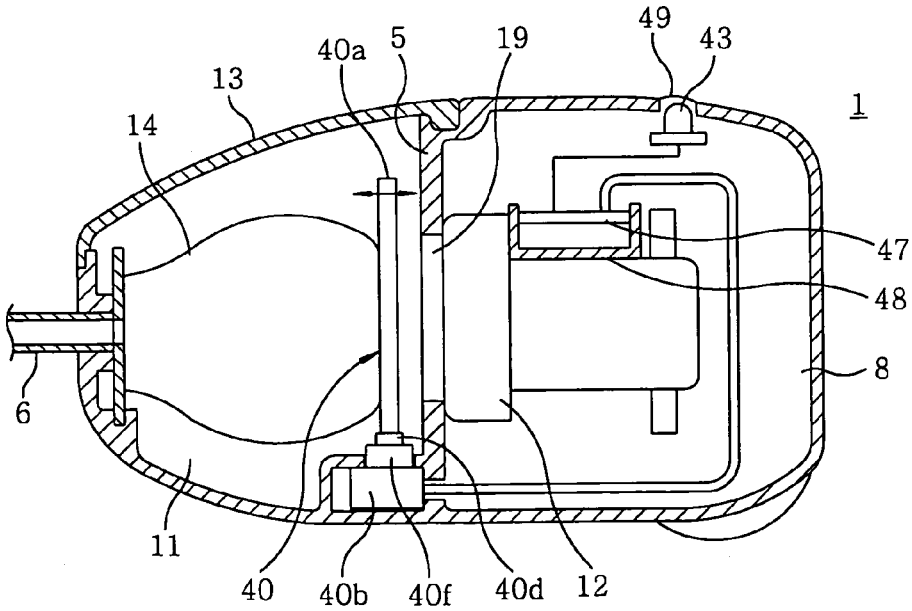
FIG. 4 provides a schematic cross sectional view of a main body of a vacuum cleaner in accordance with a second preferred embodiment of the present invention.

FIG. 3 shows a schematic diagram illustrating a grip manipulation unit 7 of the vacuum cleaner in accordance with the first preferred embodiment of the invention. Included in grip manipulation unit 7 are dust removing stop switch 25 for stopping the operation of dust removing unit 31 and LED indicator 33 serving as an informing unit.

An operation of the vacuum cleaner described above will now be explained in detail.

When electric blower 12 starts operating, a suction force is generated to thereby suction dust-laden air through a suction nozzle 3 to dust bag 14. Since dust bag 14 also serves as a filter, the dust in the dust-laden air is filtered by dust bag 14 and accumulated therein whereas dust-removed air travels to electric blower 12 through communication holes 19. In this configuration, since the suction air necessarily passes through a part of an inner surface of dust bag 14 near communication holes 19, the dust, especially, fine dust, tends to adhere thereto.

In such an occasion, even with a small amount of dust accumulated in dust bag 14, the suction force prematurely decreases so that an efficiency of cleaning work is deteriorated. In order to solve the problem, the vacuum cleaner in accordance with the first embodiment of the present invention operates as follows. When an input to electric blower 12 changes, e.g., from one of the operation modes to the power off mode, or a dust removing start switch (not shown), which can be installed in grip manipulation unit 7, is activated, the AC voltage is applied to control circuit 29 so as to drive vibrator 18 to vibrate. Driven vibrator 18 renders vibrations of dust bag 14 in a region near communication holes 19 to thereby knock the adhered dust off dust bag 14, resulting in the removal of the dust adhered to the region of dust bag 14 near communication holes 19. As a result, the suction force can be recovered and thus the efficiency of the cleaning work can be maintained. Dust removing stop unit 32 halts the operation of dust removing unit 31 by cutting off the voltage applied to control circuit 29. When dust removing stop unit 32 stops the operation of dust removing unit 31, LED indicator 33 indicates the halt of the dust removing operation, thereby enhancing user convenience.

During the dust removing operation, a user may want to manually stop the operation of dust removing unit 31, e.g., when the user notices that the suction force is recovered or the like. In such a case, the user can activate dust removing stop switch 25 to halt the dust removing operation. Therefore, the user can halt the dust removing operation at any time, thereby improving functionality and convenience.

When a mode of the vacuum cleaner is changed into one of the operation modes by the manipulation of grip manipulation unit 7, an input power level of electric blower 12 controlled by control unit 30 is changed, and thus the amount of the suction air flow is varied. Since the variation of the suction air flow gives rise to a turbulent air flow in dust chamber 11, the dust in the suction air is hardly adheres to dust bag 14 and the dust removing operation cannot be performed efficiently during that time. Therefore, dust removing stop unit 32 halts the dust removing operation of dust removing unit 31 when the input power level of electric blower 12 is changed by the manipulation of grip manipulation unit 7, thereby saving the power consumption for performing the operation of dust removing unit 31.

In general, cleaning operation is terminated when the user operates power off switch 24 to convert an operation mode of electric blower 12 into the power off mode thereof. In accordance with the first preferred embodiment of the invention, when the user activates power off switch 24 to halt the operation of electric blower 12, dust removing unit 31 starts the dust removing operation for a predetermined time period, e.g., 60 seconds, and thereafter the dust removing stop unit 32 stops the operation thereof. In such a case, therefore, there is no need to install an additional switch, e.g., a dust removing start switch, thereby lowering a manufacturing cost and enhancing user convenience. Also, the vacuum cleaner can be configured such that while the dust removing operation is being performed, the user can halt the operation at any time by activating or pressing power off switch 24 again, thereby adding greater convenience.

Also, after the dust adhered to dust bag 14 is removed by the operation of dust removing unit 31, the flow rate of the suction air is recovered. When the flow rate detected by the suction air flow detection unit 34 is increased or recovered, dust removing stop unit 32 halts the dust removing operation of dust removing unit 31, so that the power consumption for the operation of dust removing unit 31 can be reduced. When the flow rate is recovered, a vacuum pressure in dust chamber 11 drops or temperatures of electric blower 12 and its surrounding area are lowered. Therefore, by detecting the vacuum pressure within dust chamber 11 or the temperature of electric blower 12 or its surroundings area instead of detecting the flow rate of the suction air by suction air flow detection unit 34, the restoration of the flow rate can be detected and dust removing stop unit 32 can be operated to stop the dust removing operation, thereby obtaining a similar effect as in the case of directly detecting the flow rate.

If the input to electric blower 12 is high, the suction air flow is also strong and thus the dust in the suction air can be readily adhered to dust bag 14. In such a case, the dust removing operation may not be performed effectively due to an adhesive force that can be stronger than a dust removing force. Therefore, when the input to electric blower 12 is high, e.g., when electric blower 12 is in the high power mode, dust removing stop unit 32 preferably halts the operation of dust removing unit 31. In other words, when the dust removing operation is not so effective because the dust is strongly adhered to dust bag 14 by the large suction air flow, the dust removing operation of dust removing unit 31 is halted in accordance with the present invention, so that the power consumption for the dust removing operation can be decreased.

When the operation of electric blower 12 is switched from the power off mode to one of the operation modes, the input to electric blower 12 increases. Therefore, by detecting such input change to electric blower 12 by way of input detection unit 35, dust removing stop unit 32 of the present invention preferably halts the dust removing operation of dust removing unit 31. By doing so, the dust removing operation can be carried out without being affected by the suction air flow and thus the dust removing operation can be performed most efficiently, thereby enhancing the dust removing efficiency and saving the power consumption for operating dust removing unit 31.

Hood 13 is normally opened when the user removes the dust from dust chamber 11. Therefore, the dust removing effect cannot be obtained even if the dust removing operation is performed in such an occurrence. Therefore, when hood detection unit 38 detects that hood 13 is opened, the dust removing operation of dust removing unit 31 is halted by dust removing stop unit 32. In other words, when the user removes the accumulated dust from dust chamber 11, the dust removing operation is halted, thereby enhancing convenience.

Also, there is no need of operating dust removing unit 31 when dust bag 14 is not set in dust chamber 11. Therefore, when filter detection unit 36 detects that dust bag 14 is not present in dust chamber 11, the dust removing operation of dust removing unit 31 is halted by dust removing stop unit 32. In other words, when the dust removing operation is not expected, the dust removing operation is halted, thereby saving the power consumption for operating dust removing unit 31.

Cleaning cannot be done when hose 6 is detached from main body 1 and such a case can be determined as an abnormal state of the vacuum cleaner. Therefore, when hose detection unit 32 detects that hose 6 is not connected to main body 1, dust removing unit 31 is halted by dust removing stop unit 32, i.e., when the vacuum cleaner is determined to be in an abnormal state, the operation of dust removing unit 31 is terminated, thereby enhancing safety.

Also, when dust removing stop unit 32 halts the operation of dust removing unit 31, the LED serving as LED indicator 33 installed in grip manipulation unit 7 turns "ON" for a predetermined time period. Therefore, the user can recognize that the dust removing operation is halted, thereby enhancing convenience.

While the first preferred embodiment of the invention has been described for the vacuum cleaner using dust bag 14, it will be understood by those skilled in the art that the embodiment can be equally applied to a vacuum cleaner incorporating therein a cyclonic dust collecting unit to obtain same effects.

A vacuum cleaner in accordance with a second preferred embodiment of the invention will now be described with reference to FIGS. 4 to 9.

Reference numeral 40 is a vibrator serving as a dust removing unit uprightly installed in main body 1. Vibrating plate 40*a* located at an upper portion thereof abuts on the outer surface of dust bag 14 facing communication holes 19 of partition 5. Provided in control board 47 disposed in board case 48 positioned above electric blower 12 are vibrator driving switch 41 implemented by, e.g., a TRIAC, for providing, e.g., 100 V AC power to vibrator 40; vibration control circuit 42 for ON/OFF controlling vibrator driving switch 41; display control circuit 44 for driving LED 43 serving as an indicator for displaying an operation state of vibrator 40; motor control circuit 45 for controlling the operation of electric blower 12; and DC power source 46 for generating a DC power from the AC power to supply same to vibration control circuit 42 and display control circuit 44. LED 43 is fixedly mounted in display window 49 for displaying a vibrating operation.

Figure 5:
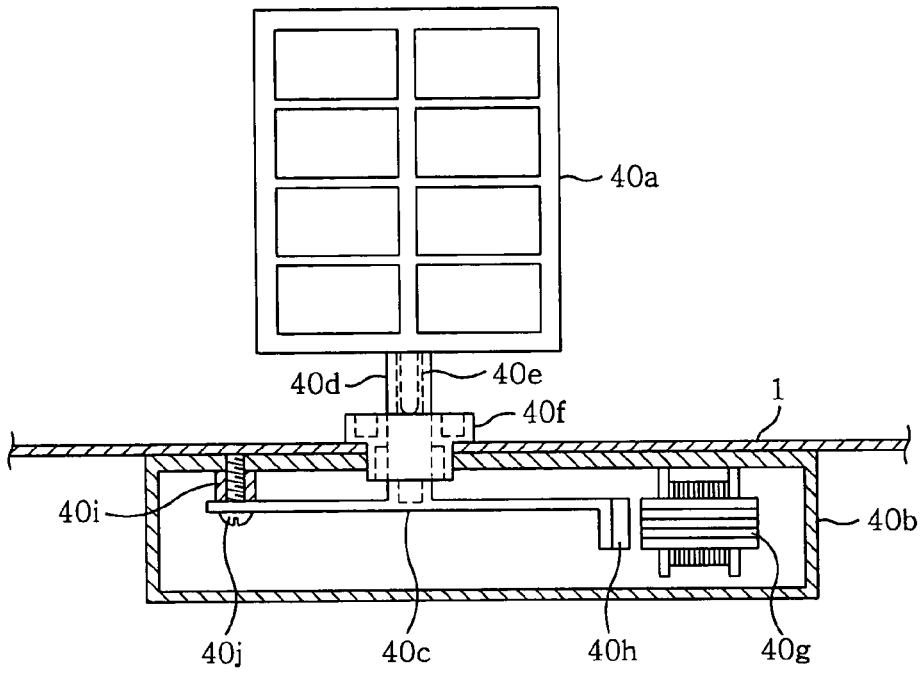
FIG. 5 depicts a schematic cross sectional side view of a vibrator of the vacuum cleaner in accordance with the second preferred embodiment of the present invention.
Figure 6:
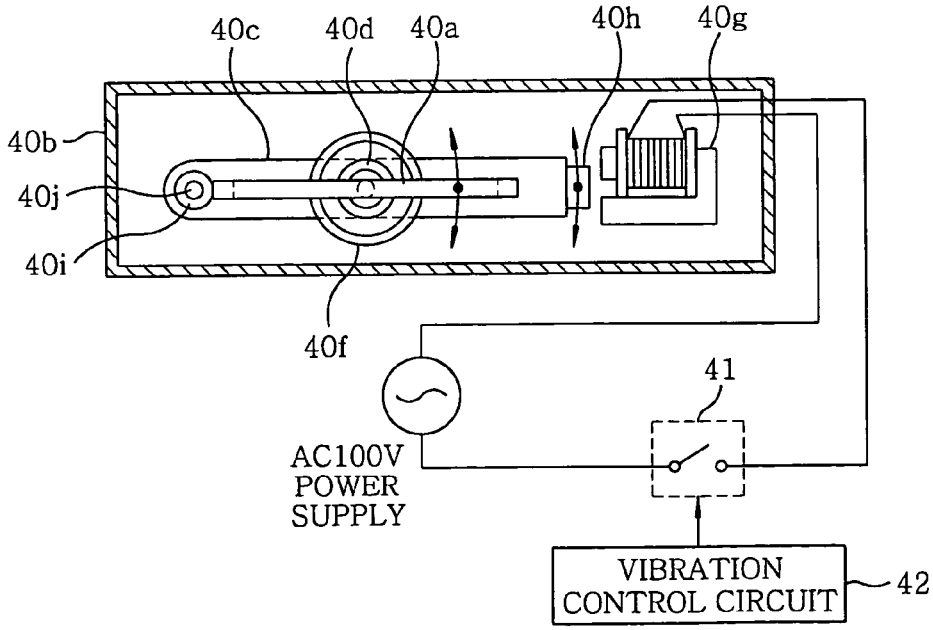
FIG. 6 presents a schematic cross sectional plan view for explaining an operation of the vibrator in accordance with the second preferred embodiment of the invention.

Configuration and operation of vibrator 40 will now be described with reference to FIGS. 5 and 6. Vibrator 40 is fixed in a lower portion of dust chamber 11 of main body 1. Protruded into dust chamber 11 is substantially cylindrical arm 40*d* having a hollow portion therein and vertically extended from movable plate 40*c* in body case 40*b* of vibrator 40. Fitted into the hollow portion of arm 40*d* is protrusion 40*e* downwardly extending from a lower portion of vibrating plate 40*a* having a lattice shape. Since vibrating plate 40*a* abuts on the outer surface of dust bag 14 facing communication holes 19 of partition 5, vibrating plate 40*a* has the lattice shape not to block the suction air suctioned into communication holes 19 through dust bag 14.

Arm 40*d* is also fixed to body case 40*b* via resilient bushing 40*f* having a ring shape and made of, e.g., rubber. Installed in body case 40*b* are electromagnet 40*g* and movable plate 40*c* having permanent magnet 40*h* at one end thereof facing an operational surface of electromagnet 40*g*, permanent magnet 40*h* being disposed parallel therewith. At another end of movable plate 40*c* opposite to the one end housing permanent magnet 40*h* is rotatably fixed to body case 40*b* by means of screw 40*j* through sleeve 40*i* made of, e.g., rubber. When vibrator driving switch 41 is turned "on" by vibration control circuit 42, AC voltage, e.g., AC 100V is supplied to electromagnet 40*g* to generate a magnetic field therearound. Due to the magnetic field generated around electromagnet 40*g*, movable plate 40*c* is pivoted about its fixed end, which in turn moves or vibrates at a frequency of the AC power (50 or 60 Hz for example) arm 40*d* supported by resilient bushing 40*f* in the direction indicated by the arrow as shown in FIG. 6. Subsequently, since the vibration of arm 40*d* is transferred to vibrating plate 40*a*, vibrating plate 40*a* moves in the direction indicated by the above-mentioned arrow as well, thereby vibrating dust bag 14 repeatedly. By doing this, the dust adhered to dust bag 14 can be removed.

Figure 7:
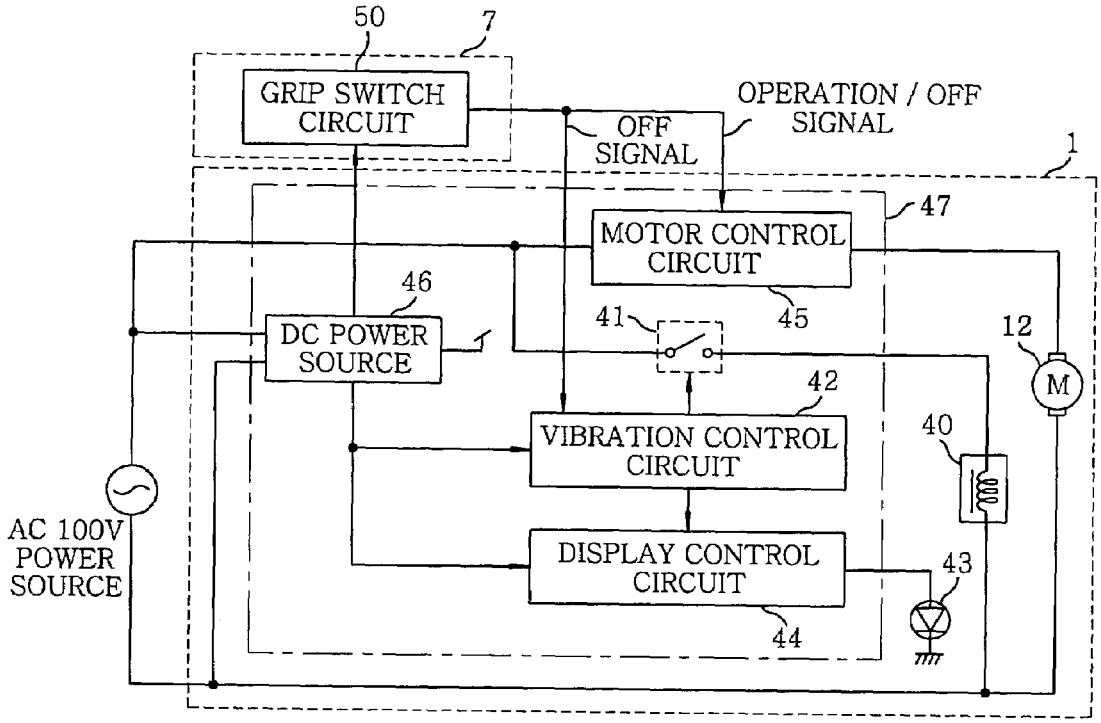
FIG. 7 represents a schematic circuit block diagram for controlling an indicator for the operation of the vibrator in accordance with the second preferred embodiment of the invention.
Figure 8:
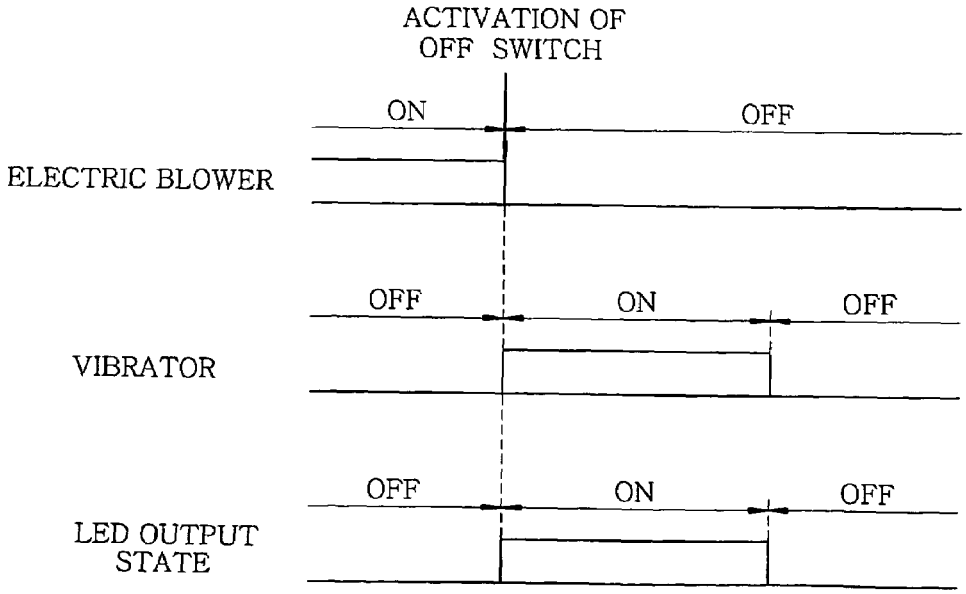
FIG. 8 illustrates a schematic diagram for explaining an LED display method for displaying the operation of the vibrator in accordance with the second preferred embodiment of the invention.

The indication scheme for the vibration dust removing operation in the above configuration will now be described with reference to FIGS. 7 to 8.

When the AC voltage, e.g., AC 100 V, is supplied to main body 1, a DC power is provided from DC power source 46 to vibration control circuit 42; display control circuit 44; and grip switch circuit 50 incorporating therein, e.g., an operation switch (not shown) for starting the operation of electric blower 12 and a power OFF switch (not shown) for halting the operation of electric blower 12. When the operation switch in grip switch circuit 50 is switched to operate, a driving signal is provided to motor control circuit 45 in control board 47 so that electric blower 12 is operated and the dust is accumulated in dust bag 14.

Next, when the power OFF switch in grip switch circuit 50 is switched to operate after finishing the cleaning, a power off signal is inputted to motor control circuit 45 and vibration control circuit 42. In response to the power off signal from grip switch circuit, motor control circuit 45 halts the operation of electric blower 12 and simultaneously vibration control circuit 42 switches "on" vibrator driving switch 41 to operate vibrator 40. Also, vibration control circuit 42 outputs a vibration start signal to display control circuit 44. In response to the vibration start signal, display control circuit 44 turns on LED 43.

After vibrator 40 is operated for a predetermined time, e.g., 60 seconds, enough to remove the dust adhered to dust bag 14, vibrating control circuit 42 switches off vibrator driving switch 41 and simultaneously provides a vibration end signal to display control circuit 44. Responding to the vibration end signal, display control circuit 44 turns off LED 43. As a result, the user can see an operational state of vibrator 40 by checking the on/off state of LED 43 displayed through display window 49 installed at an upper portion of main body 1. Therefore, the user can easily recognize whether vibrator 40 is properly operated or not, which in turn prevents the user from prematurely disconnecting the power of the vacuum cleaner before the dust removing operation is completed.

The preferred embodiment of the present invention has been described for the case, wherein when vibrator 40 is operated, LED 43 is turned on; and when vibrator 40 is stopped, LED 43 is turned off. However, same effects can be obtained by way of blinking LED 43 when vibrator 40 is operated and turning on or off LED 43 when vibrator 40 is not on. Alternatively, by employing a 2 color LED as LED 43, the on and off states of vibrator 40 can be represented by different colors.

Figure 9:
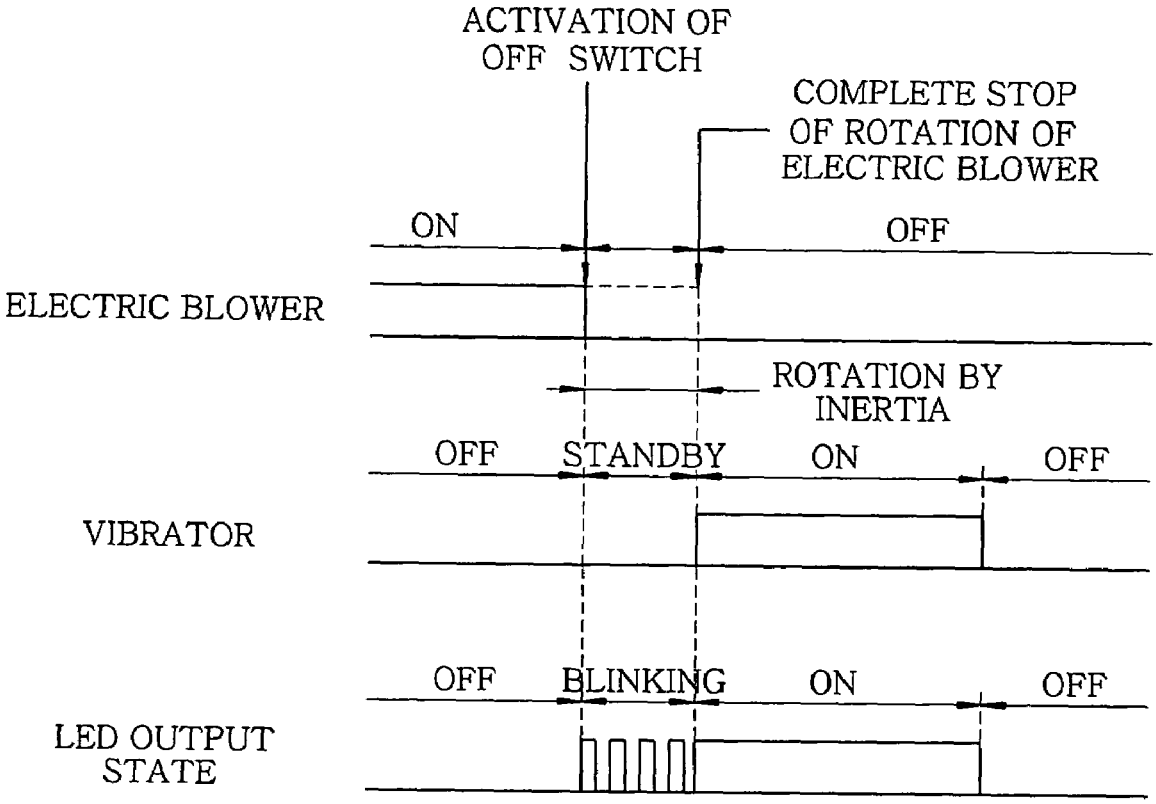
FIG. 9 shows a schematic diagram for explaining an LED display method having a standby period for displaying the operation of the vibrator in accordance with the second preferred embodiment of the invention.

The second preferred embodiment of the invention has been described for the case where vibrator 40 starts operating right after electric blower 12 is stopped. However, even after the user completes the cleaning work and halts electric blower 12 by using grip switch circuit 50, electric blower 12 keeps rotating by inertia for a while and thus the dust in dust bag 14 can drift therein during that period. Therefore, the operation of vibrator 40 during that period may not efficiently remove the dust adhered to the inner surface of dust bag 14. Therefore, the dust removing operation of vibrator 40 may be preferably delayed by a standby period at the end of which electric blower is completely stopped. During the standby period, as shown in FIG. 9, vibrator 40 is not operated and LED 43 blinks. After the standby period, vibrator 40 is operated and LED 43 is turned on. By doing this, the user can recognize the progress of the series of the dust removing operation of the vacuum cleaner. Therefore, the vacuum cleaner can be prevented from being unplugged before the dust removing operation is completed, so that the original object of the dust removing operation for preventing the reduction of the suction force can be achieved.

Also, by employing for LED 43 a 2 color LED to emit different colored lights during the standby period and the dust removing operation period, respectively, in the configuration described above, the user can recognize the series of operation by different colors emitted from LED 43.

Figure 10:
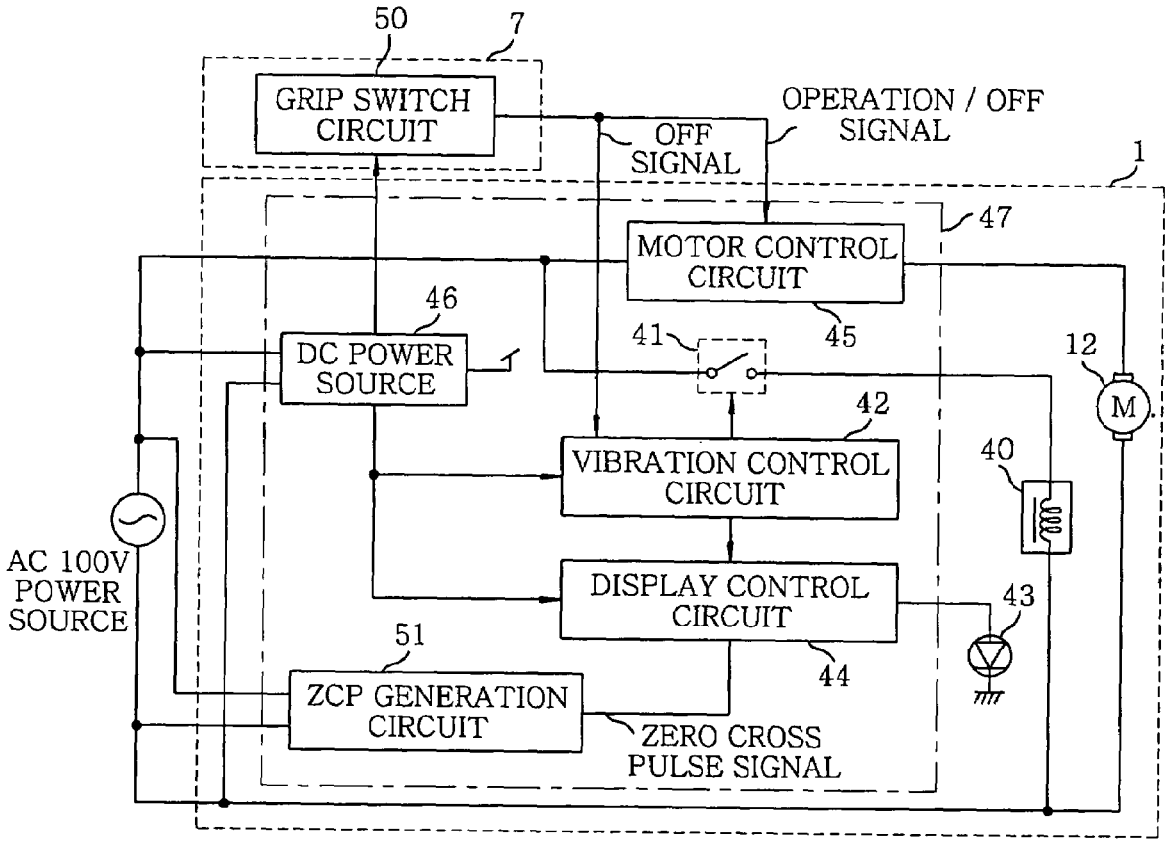
FIG. 10 provides a schematic circuit block diagram for controlling a display for the operation of a vibrator in accordance with a third preferred embodiment of the present invention.
Figure 11:
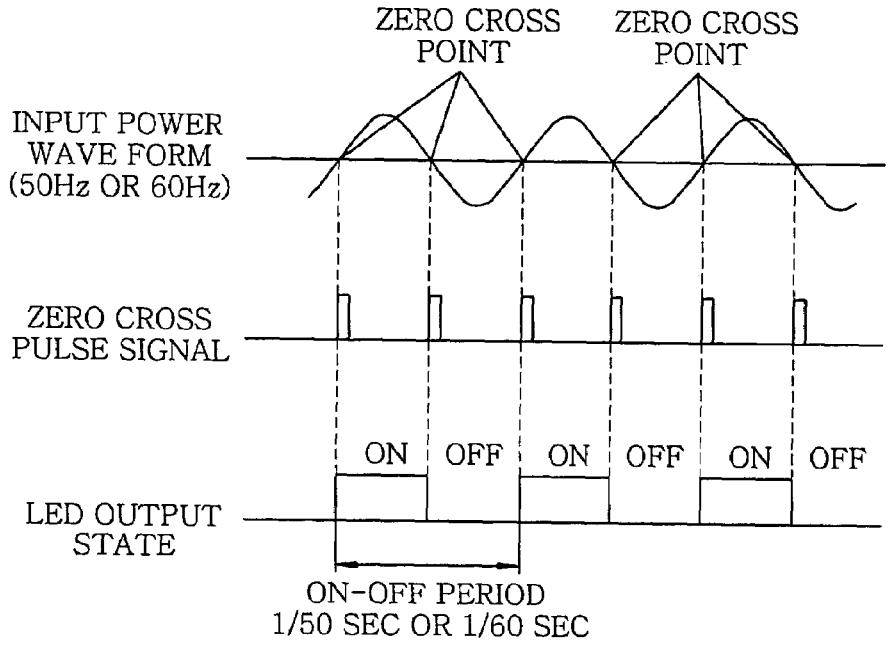
FIG. 11 depicts a schematic diagram for explaining an LED display method for displaying the operation of the vibrator in accordance with the third preferred embodiment of the invention.

A third preferred embodiment will now be described with reference to FIGS. 10 and 11. The configurations of main body 1 and vibrator 40 in this embodiment are identical to those of the second embodiment. Therefore, like parts appearing in the second preferred embodiment are designated by like reference numerals and detailed explanation thereof will be omitted.

Incorporated in the vacuum cleaner in accordance with the third preferred embodiment of the invention is a ZCP generation circuit 51 for generating zero cross pulse (ZCP) signals at every zero cross point of the AC 100 V power. Using ZCP generation circuit 51, LED 43 can be made to blink with a blinking period synchronized with a vibration period of vibrator 40. When the AC 100 V power is applied to main body 1, ZCP generation circuit 51 in control board 47 detects the zero cross points of the AC 100 V power to generate the ZCP signals synchronized with the period of the AC 100 V power having a frequency of, e.g., 50 Hz or 60 Hz, to supply same to display control circuit 44 for controlling on and off operation of LED 43.

When the cleaning work is completed and the power off switch in grip switch circuit 50 is operated, the power off signal is inputted to motor control circuit 45 and vibration control circuit 42. In response to the power off signal, motor control circuit 45 halts the operation of electric blower 12 and vibration control circuit 42 switches on vibrator driving switch 41 to supply the AC 100 V power to vibrator 40. Vibrating plate 40*a* in vibrator 40 supplied with the AC 100 V power will be made to vibrate with the vibration period synchronized with that of the AC 100 V power having the frequency of, e.g., 50 Hz or 60 Hz, thereby removing the dust adhered to dust bag 14. Simultaneously, vibration control circuit 42 provides a vibration start signal to display control circuit 44. In response to the vibration start signal, display control circuit 44 repeatedly turns on and off LED 43 in accordance with the ZCP signals in turn to thereby perform a blinking control synchronized with the period of the AC 100 V power having the frequency of, e.g., 50 Hz or 60 Hz.

After vibrator 40 has been operated for a predetermined time enough to remove the dust adhered to dust bag 14, vibrating control circuit 42 switches off vibrator driving switch 41 and outputs a vibrating end signal to display control circuit 44. Responding to the vibrating end signal, display control circuit 44 turns off LED 43.

As a result, the user can recognize the operational state of vibrator 40 from the blinking of LED 43 displayed through display window 49 installed at an upper portion of main body 1. Therefore, the user can easily recognize whether vibrator 40 is being properly operated or not, which in turn prevents the user from prematurely disconnecting the power of the vacuum cleaner before the dust removing operation is completed.

While LED 43 in the second and the third preferred embodiment has been described as being simply emitting light, LED 43 can be made to provide a patterned image to display characters, e.g., "UNDER DUST REMOVING" and also can be made to blink and to be turned on and off while changing display colors to obtain same effects.

A fourth preferred embodiment of the present invention will now be described with reference to FIGS. 12 and 13. Main body 1 and vibrator 40 in the current embodiment are identical to those of the second embodiment. Therefore, like parts appearing in the second preferred embodiment are designated by like reference numerals and detailed explanation thereof will be omitted.

Figure 12:
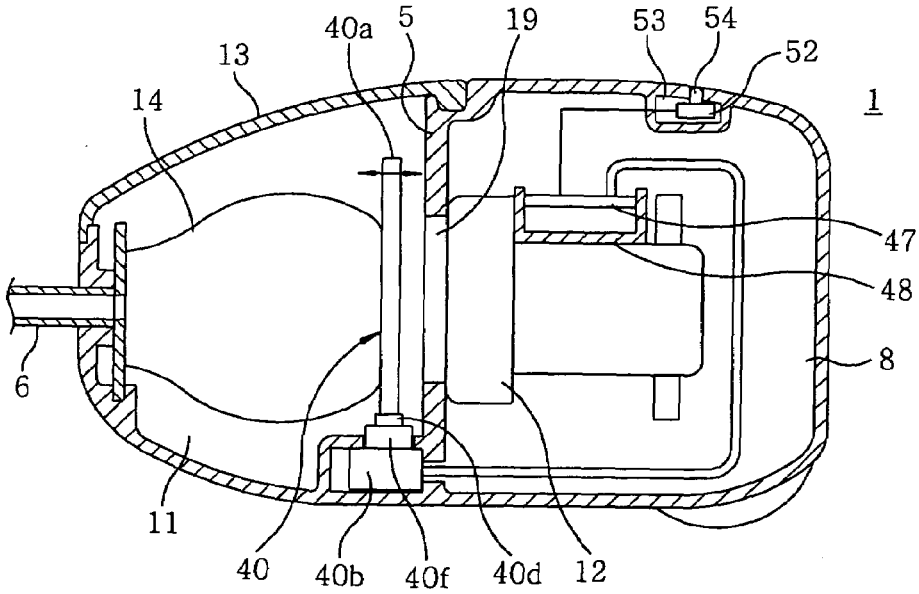
FIG. 12 presents a cross sectional side view of a main body in accordance with a fourth preferred embodiment of the present invention.
Figure 13:
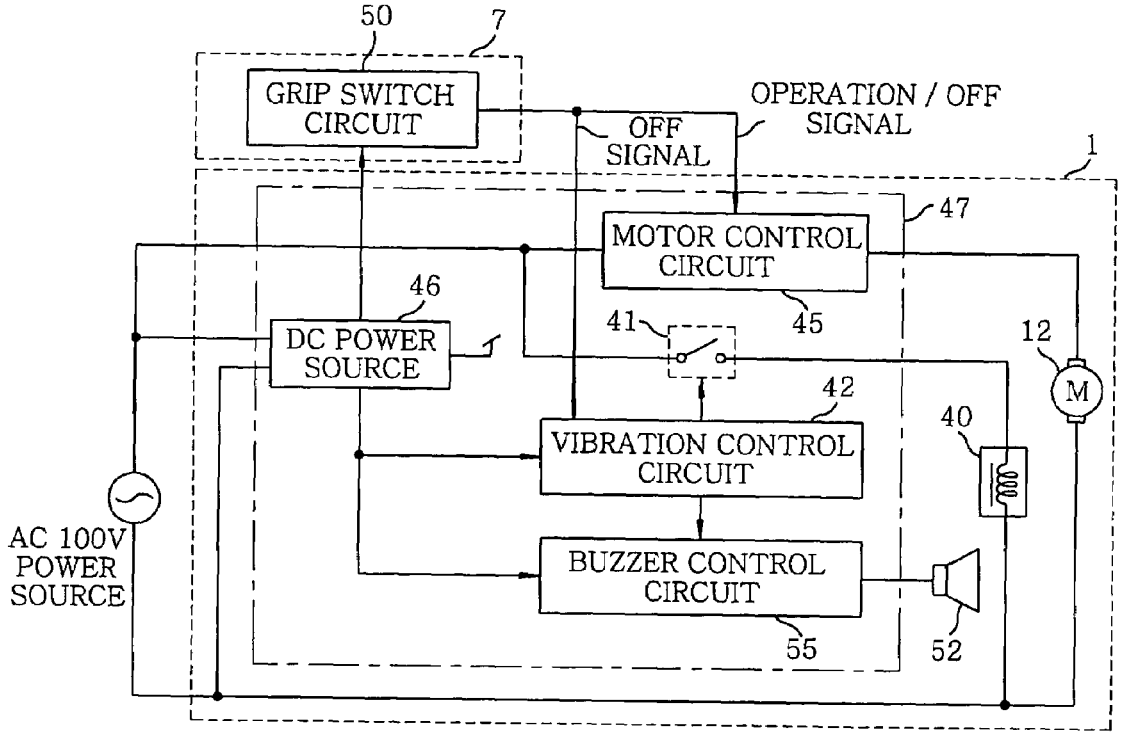
FIG. 13 represents a schematic circuit block diagram for controlling an indicator for the operation of a vibrator in accordance with the fourth preferred embodiment of the invention.

FIG. 12 represents a cross sectional side view of main body 1 in accordance with the fourth preferred embodiment of the invention. Fixed in storage area 53 installed at an upper portion of electric blower housing chamber 8 located in a rear part of main body 1 is buzzer 52, e.g., a piezoelectric buzzer for informing the vibrating operation. Provided at a part of the upper surface of main body 1 above storage area 53 is opening 54 for outputting a sound generated from buzzer 52. Also, buzzer 52 is connected to control board 47 in board case 48 disposed above electric blower 12.

The indication scheme for the vibration dust removing operation in the above configuration will now be described with reference to FIG. 13.

When the AC 100 V power is supplied to main body 1, a DC power is provided from DC power source 46 to vibration control circuit 42; display control circuit 44; and grip switch circuit 50 incorporating therein, e.g., an operation switch (not shown) for starting the operation of electric blower 12 and a power OFF switch (not shown) for halting the operation of electric blower 12. When the operation switch in grip switch circuit 50 is operated, a driving signal is provided to motor control circuit 45 in control board 47 so that electric blower 12 is operated and the dust is accumulated in dust bag 14.

Next, when the power OFF switch in grip switch circuit 50 is operated after finishing the cleaning, a power off signal is inputted to motor control circuit 45 and vibration control circuit 42. In response to the power off signal from grip switch circuit, motor control circuit 45 halts the operation of electric blower 12 and simultaneously vibration control circuit 42 switches "on" vibrator driving switch 41 to operate vibrator 40.

Also, vibration control circuit 42 outputs a vibration start signal to buzzer control circuit 55. Responding to the vibration start signal, buzzer control circuit 44 makes the buzzer 52 generate the sound. After vibrator 40 is operated for a predetermined time, e.g., 60 seconds, enough to remove the dust adhered to dust bag 14, vibrating control circuit 42 switches off vibrator driving switch 41 and simultaneously provides a vibration end signal to buzzer control circuit 55. Responding to the vibration end signal, buzzer control circuit 55 stops the sound generation of buzzer 52.

As a result, the user can recognize an operational state of vibrator 40 by hearing the sound of buzzer 52 through opening 54 installed at the upper portion of main body 1. Therefore, the user can easily recognize whether vibrator 40 is properly operated or not, which can help to prevent the user from prematurely disconnecting the power of the vacuum cleaner before the dust removing operation is completed.

While the fourth preferred embodiment of the present invention has been described for the case where buzzer 52 makes the continuous buzzing sound while vibrator 40 is operated and the buzzer 52 stops the buzzing sound when the vibrator 40 is halted, it will be understood by those skilled in the art that same effects can be obtained by constructing the above configuration as follows: The buzzer 52 makes an intermittent buzzing sound during the vibrating operation of vibrator 40 and buzzer 52 stops the generation of buzzing sound when the vibrating operation of the vibrator 40 is halted, which can reduce the noise level since the noise level of the intermittent buzzing sound is lower than that of the continuous buzzing sound.

A fifth preferred embodiment will now be described with reference to FIGS. 14 and 15. Main body 1 and vibrator 40 in the current embodiment are identical to those of the second embodiment. Therefore, like parts appearing in the second preferred embodiment are designated by like reference numerals and detailed explanation thereof will be omitted.

Figure 14:
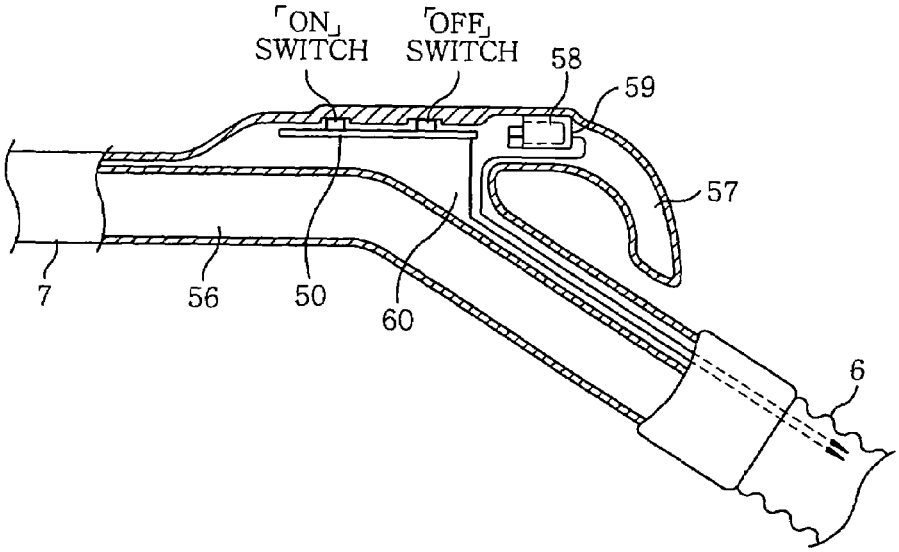
FIG. 14 illustrates a cross sectional side view of a handle in accordance with a fifth preferred embodiment of the present invention.
Figure 15:
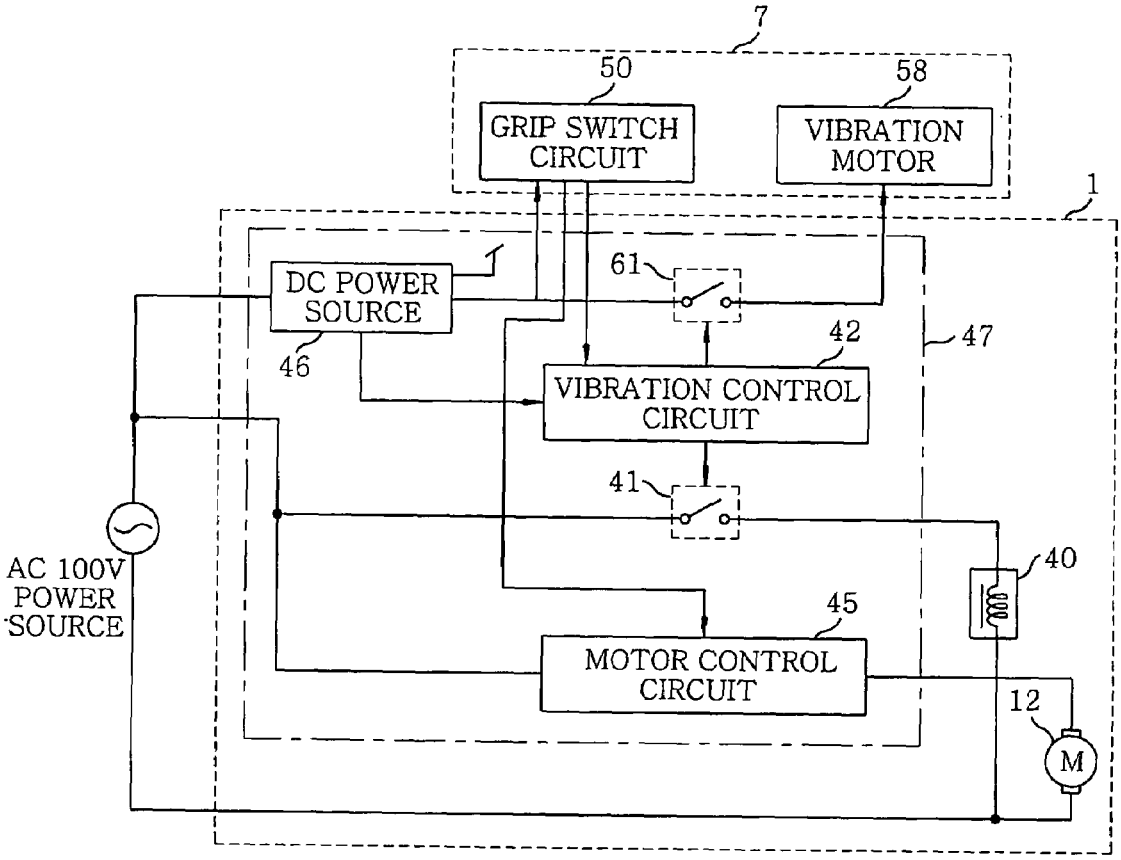
FIG. 15 shows a schematic circuit block diagram for controlling an indicator for the operation of a vibrator in accordance with the fifth preferred embodiment of the invention.

FIG. 14 illustrates a partial cutaway cross sectional side view of grip manipulation unit 7. Incorporated in grip portion 57 over air path 56 in grip manipulation unit 7 are grip switch circuit 50 and vibration motor 58 incorporating therein a motor shaft (not shown) with a weight mounted at one end thereof, wherein the whole motor vibrates when the motor shaft rotates. Mounted in grip portion 57 is vibration motor 58 covered with motor holder 59 made of, e.g., rubber.

Grip switch circuit 50 and vibration motor 58 serving as a vibration source are connected to control board 47 in main body 1 via wiring space 60 for accommodating therein signal lines and hose 6. Wiring space 60 is separated from air path 56.

The indication scheme for the vibration dust removing operation in the above configuration will now be described with reference to FIG. 15.

When the AC 100 V power is supplied to main body 1, a DC power is provided from DC power source 46 to vibration control circuit 42 and grip switch circuit 50 incorporating therein, e.g., an operation switch for starting the operation of electric blower 12 and a power OFF switch for halting the operation of electric blower 12. When the operation switch in grip switch circuit 50 is operated, a driving signal is provided to motor control circuit 45 in control board 47 so that electric blower 12 is operated and the dust is accumulated in dust bag 14. Next, when the power OFF switch in grip switch circuit 50 is operated after finishing the cleaning, a power off signal is inputted to motor control circuit 45 and vibration control circuit 42. In response to the power off signal from grip switch circuit 50, motor control circuit 45 halts the operation of electric blower 12 and simultaneously vibration control circuit 42 switches "on" vibrator driving switch 41 to operate vibrator 40.

At the same time, vibration control circuit 42 switches on vibration motor driving switch 61 so that power from DC power source 46 is supplied to vibration motor 58 to start operating vibration motor 58. The vibration of vibration motor 58 is transmitted to grip portion 57 in grip manipulation unit 7 via motor holder 59, thereby making grip portion 57 in grip manipulation unit 7 vibrate. After vibrator 40 is operated for a predetermined time enough to remove the dust adhered to dust bag 14, vibration control circuit 42 switches off vibrator driving switch 41 and vibration motor driving switch 61 to cut off the power to vibration motor 58, thereby halting the vibration of grip portion 57 in grip manipulation unit 7.

As a result, the user can notice the operation and stop state of vibrator 40 by the presence and the absence of the vibration in grip portion 57 of grip manipulation unit 7. Therefore, the user can easily recognize whether vibrator 40 is properly operated or not, which, in turn, can help to prevent the user from prematurely disconnecting the power of the vacuum cleaner before the dust removing operation is completed.

While the fifth preferred embodiment of the present invention has been described for vibration motor 58 serving to vibrate grip portion 57, it will be understood by those skilled in the art that same effects can be obtained by using an ultrasonic vibrator instead of vibration motor 58.

While the second to fifth preferred embodiments of the invention have been described for dust bag 14 detachably held in dust chamber 11 for accumulating the suctioned dust, it will be understood by those skilled in the art that same effects can be obtained when applying the present invention to remove the dust adhered to an external surface of a filter incorporated in a substantially cylindrical dust chamber employing a cyclonic dirt collection mechanism.

While the invention has been shown and described with respect to the preferred embodiments, it will be understood by those skilled in the art that various changes and modifications may be made without departing from the spirit and scope of the invention as defined in the following claims.

What is claimed is:

1. A vacuum cleaner comprising:

an electric blower for generating suction air;

a collecting unit for collecting dust contained in the suction air;

a dust removing unit for removing dust adhered to the collecting unit;

a dust removing stop unit capable of stopping an operation of the dust removing unit while the electric blower operates; and a power off switch for cutting off a power to the electric blower.

2. The vacuum cleaner of claim 1, wherein the dust removing stop unit is a stop switch operated by a user and disposed separately from the power off switch.

3. The vacuum cleaner of claim 1, further comprising a mode conversion switch for operating the electric blower at one of various power modes, a different input power being applied to the electric blower for a different power mode, and wherein the operation of the dust removing unit is halted when the mode conversion switch is activated by a user.

4. The vacuum cleaner of claim 3, wherein the operation of the dust removing unit is stopped when the power off switch is operated by the user.

5. The vacuum cleaner of claim 1, further comprising an input detection unit for detecting an input power to the electric blower, wherein the operation of the dust removing unit is halted when the input detection unit detects a change in the input power to the electric blower.

6. The vacuum cleaner of claim 5, wherein the operation of the dust removing unit is halted when the input detection unit detects an increase in the input power to the electric blower.

7. The vacuum cleaner of claim 6, wherein the operation of the dust removing unit is halted when the input detection unit detects that the input power to the electric blower changes from a power off mode to a power on mode.

8. The vacuum cleaner of claim 1, further comprising a hood for covering the collecting unit and a hood detection unit for detecting whether the hood is open or not, and wherein the operation of the dust removing unit is halted or a halted state of the dust removing unit is maintained when the hood detection unit finds that the hood is opened.

9. The vacuum cleaner of claim 1, further comprising a collecting unit detection unit for determining whether the collecting unit is installed or not, and wherein the operation of the dust removing unit is halted or a halted state of the dust removing unit is maintained when the collecting unit detection unit detects an absence of the collecting unit.

10. The vacuum cleaner of claim 1, further comprising a hose installed to a main body of the vacuum cleaner and for guiding the suction air to the collecting unit and a hose detection unit for finding whether the hose is connected to the main body or not, and wherein the operation of the dust removing unit is halted or a halted state of the dust removing unit is maintained when the hose detection unit detects that the hose is not connected to the main body.

11. A vacuum cleaner comprising:

an electric blower for generating suction air;

a collecting unit for collecting dust contained in the suction air;

a dust removing unit for removing dust adhered to the collecting unit;

a dust removing stop unit capable of stopping an operation of the dust removing unit while the electric blower operates; and indication unit for informing a user on an operation state of the dust removing unit.

12. The vacuum cleaner of claim 11, wherein the indication unit includes a light emitter.

13. The vacuum cleaner of claim 12, wherein the light emitter is turned on while the dust removing unit is operated and is turned off when an operation of the dust removing unit is stopped.

14. The vacuum cleaner of claim 12, wherein the light emitter generates lights of different colors to indicate a turn on and a turn off state of the dust removing unit, respectively.

15. The vacuum cleaner of claim 12, wherein the light emitter is made to keep blinking while the dust removing unit is turned on and is turned off when the dust removing unit is turned off.

16. The vacuum cleaner of claim 12, wherein the light emitter is made to keep blinking while the dust removing unit is turned on and is turned on when the dust removing unit is turned off.

17. The vacuum cleaner of claim 11, wherein the indication unit includes a sound generating unit.

18. The vacuum cleaner of claim 17, wherein the sound generating unit generates a sound while the dust removing unit is turned on and stops generating the sound when the dust removing unit is turned off.

19. The vacuum cleaner of claim 11, wherein the indication unit includes a vibration generation unit generating a vibration synchronized with a vibrational operation of a vibrator serving as the dust removing unit and is disposed at a grip portion of the vacuum cleaner.

20. The vacuum cleaner of claim 1, further comprising a detecting unit for detecting operation states of the vacuum cleaner, wherein the dust removing stop unit selectively stops the operation of the dust removing unit depending on the operation states.

* * * * *